United States Patent [19]

Hilshorst

[11] 4,366,991

[45] Jan. 4, 1983

[54] PAVEMENT PLANING DEVICE

[76] Inventor: Howard H. Hilshorst, 10226 Roppelt Rd., Cincinnati, Ohio 45247

[21] Appl. No.: 230,863

[22] Filed: Feb. 2, 1981

Related U.S. Application Data

[63] Continuation-in-part of Ser. No. 604,601, Aug. 14, 1975, Pat. No. 4,332,422.

[51] Int. Cl.[3] ..... E01C 23/12

[52] U.S. Cl. ..... 299/39; 299/85

[58] Field of Search ..... 299/39, 93, 36, 40, 299/85

[56] References Cited

U.S. PATENT DOCUMENTS 2,520,229 8/1950 Tranger ..... 299/39
2,691,511 10/1954 Lurdquist ..... 299/85
2,787,943 4/1957 Browning ..... 299/39
3,223,451 12/1965 Orr ..... 299/39
3,761,133 9/1973 Buckley ..... 299/85

*Primary Examiner*—William F. Pate, III
*Attorney, Agent, or Firm*—Edward J. Utz

[57] ABSTRACT

A pavement planing device including a rotating wheel on which a plurality of cutter holders are pivotally mounted. Restraining stop members mounted on the wheel limit outward swinging of the cutter holders as the wheel is rotated. Retraction stop members mounted on the wheel are engaged by the cutter holder members as they swing backwardly following impact with the surface of the pavement. The cutter holder members can rebound from the retraction stop members to cause multiple tool impacts by each cutter holder during a single pass on the surface being cut.

8 Claims, 7 Drawing Figures

PAVEMENT PLANING DEVICE

CROSS REFERENCE TO RELATED APPLICATION

This application is a continuation-in-part of applicant's copending application Ser. No. 604,601, filed Aug. 14, 1975, and entitled, "Pavement Planing Device." U.S. Pat. No. 4,332,422.

This invention relates to a machine for removing a portion of a hard, brittle surface. More particularly, this invention relates to a machine for chipping away or planing a surface portion of a pavement or the like.

An object of this invention is to provide a pavement planing machine in which impact chipping cutter members chip or plane the surface of a pavement or the like.

A further object of this invention is to provide such a machine in which each cutter member, after making an impact, swings back and bounces against a retraction stop member to cause the cutter member to make additional impacts.

A further object of this invention is to provide such a device in which chisel tool elements are removably mounted in the cutter members so that the chisel tool elements can be changed as the cutting surfaces wear.

SUMMARY OF THE INVENTION

Briefly, this invention provides a pavement planing machine which includes a shaft on which a cutter support assembly or wheel is mounted. The cutter support assembly includes a plurality of spaced plates between which cutter members are pivotally mounted. Each cutter member carries a chisel tool element which is engageable with the pavement. Retraction stop members are mounted behind the cutter members, and each cutter member can swing back against an associated retraction stop member after a first impact against the pavement surface to rebound and impart a second or additional impacts. Forward swinging of the cutter members is limited so that each cutter member assumes a proper position before the chisel tool element carried by the cutter member is caused to make an impact upon the pavement.

BRIEF DESCRIPTION OF THE DRAWINGS

The above and other objects and features of the invention will be apparent to those skilled in the art to which this invention pertains from the following detailed description and the drawings, in which.

DESCRIPTION OF THE PREFERRED EMBODIMENTS

Figures 1, 2:
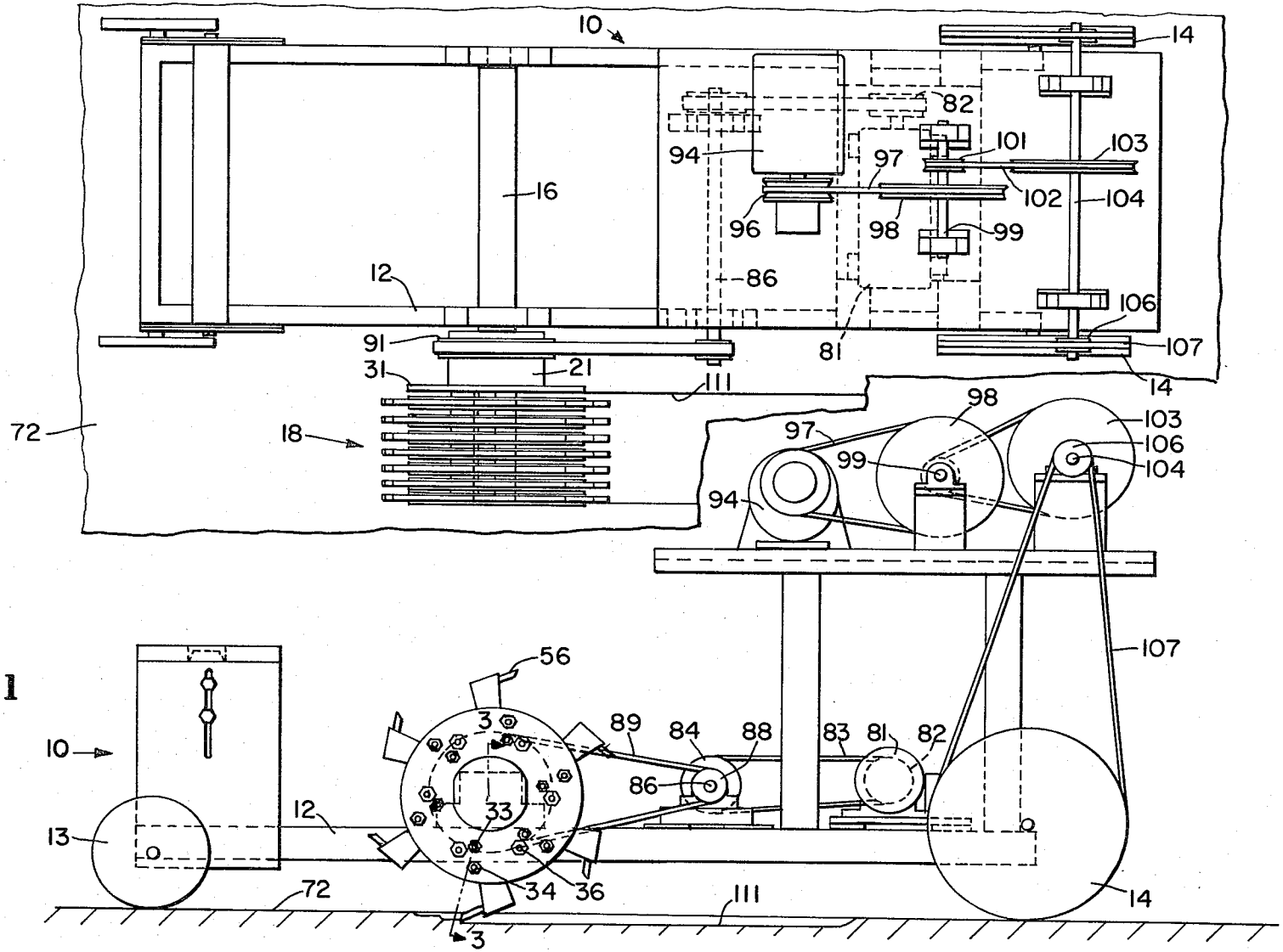
FIG. 1 is a view in side elevation of a planing machine constructed in accordance with an embodiment of this invention.
FIG. 2 is a top plan view thereof.

In the following detailed description and the drawings, like reference characters indicate like parts.

In FIGS. 1 and 2 is shown a pavement planing machine 10 constructed in accordance with an embodiment of this invention. The machine 10 includes a framework 12 supported on front wheels 13 and rear wheels 14. A cross shaft 16 is attached to the framework 12 with an end portion thereof extending cantilever fashion to one side of the framework 12.

Figure 3:
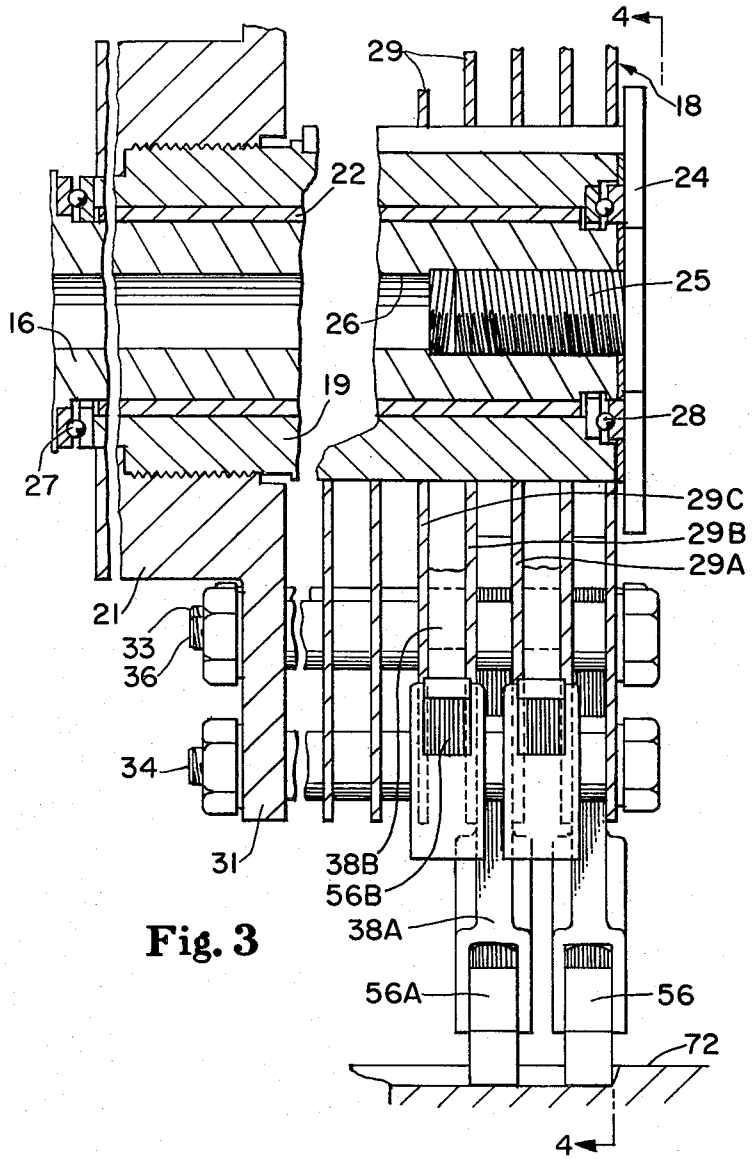
FIG. 3 is a view in section taken on an enlarged scale generally on the line 3—3 in FIG. 1.

A cutter support assembly or wheel 18 is rotatably mounted on the shaft 16 as shown in FIG. 3. The assembly 18 includes an inner tubular member 19 rotatably mounted on the shaft 16 and a flange member 21 threaded on the tubular member 19. A bearing sleeve 22 is provided between the shaft 16 and the tubular member 19. An end cap 24 having a bolt portion 25 threaded in a central bore 26 of the shaft 16 retains the assembly 18 and bearings 27 and 28 in position on the shaft 16.

A plurality of spacer plates 29 is mounted on the assembly 18 and keyed to the tubular member 19. The spacer plates 29 are connected together and to an annular flange 31 of the flange member 21 by pivot bolts 33, restraining stop supporting bolts 34, and retraction stop supporting bolts 36.

Figure 4:
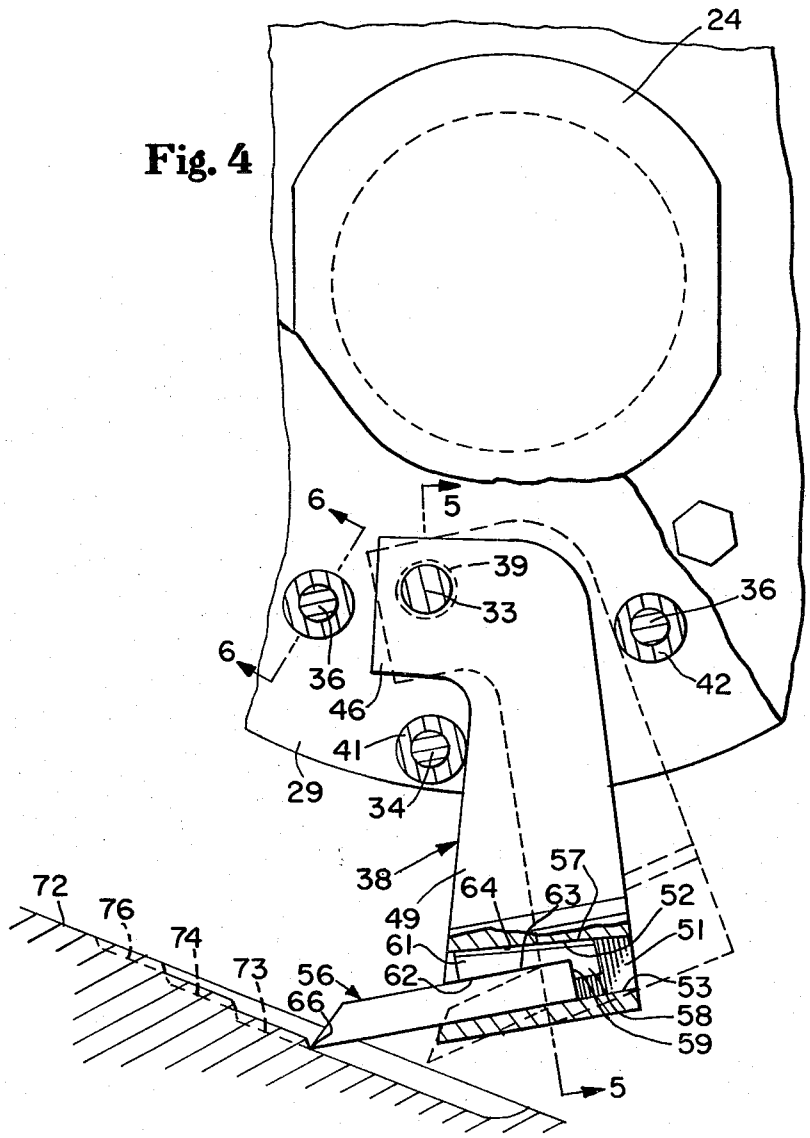
FIG. 4 is a fragmentary cross-sectional view taken generally along the line 4—4 in FIG. 3, and in which a retracted position of a cutter holder member and of its associated cutting tool is shown in dot-dash lines.

On each of the pivot bolts 33 is pivotally mounted a plurality of cutter holder members 38 (FIG. 4). In addition, a plurality of spacer sleeves 39 (FIGS. 4 and 5) is mounted on each of the pivot bolts 33. The cutter holder members 38 and the spacer sleeves 39 are mounted between adjacent plates 29, and the cutter holder members 38 and the spacer sleeves 39 alternate along each of the pivot bolts 33. On each of the restraining stop supporting bolts 34 is mounted a plurality of tubular restrainer stop members 41, each of which is positioned between adjacent plates 29. On each of the retraction stop supporting bolts (FIG. 6) is mounted a plurality of tubular retraction stop members or rings 42, each of which is positioned between adjacent plates 29.

Figure 5:
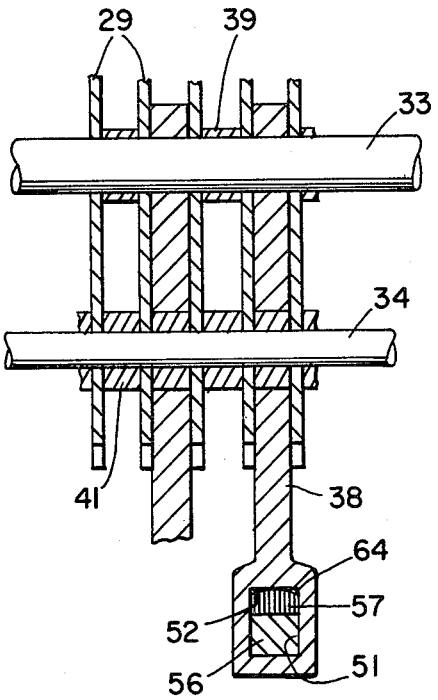
FIG. 5 is a fragmentary view in section taken generally on the line 5—5 in FIG. 4.
Figure 6:
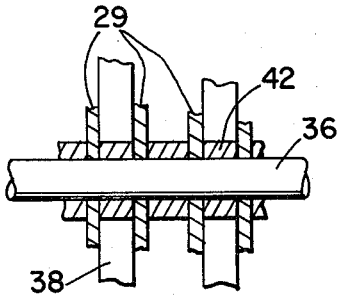
FIG. 6 is a fragmentary view in section taken on the line 6—6 in FIG. 4.

As shown in FIGS. 3 and 4, each of the cutter holder members 38 is of generally L-shape. Adjacent an end of a first arm 46 (FIG. 4) of the body 44 is a transverse bearing bore 47 in which an associated one of the pivot bolts 33 is received for pivotally supporting the member 38. At an outer end portion of a second arm 49 of the member 38 is a socket 51. As shown in FIG. 4, an upper wall 52 and a lower wall 53 of the socket 51 converge toward the right. A chisel-like cutting tool or bit 56 of rectangular cross-section is mounted in the socket 51. The tool 56 is held by an L-shaped tool-holding wedge member 57. The wedge member 57 includes a hook arm portion 58 which engages a rear wall 59 of the tool 56. A main arm 61 of the wedge member 57 includes a tool-engaging face 62, which fits in face-to-face relation to a face 63 of the tool 56 and a sloping, arched face 64 which is engaged by the upper socket wall 52. As shown in FIG. 5, the face 64 is convexly arched so that the face 64 engages the wall 52 along a line of contact. The tool 56 and the wedge member 57 form an assembly which is wedged in the socket 51 with a sharpened tip 66 of the tool 56 extending outwardly to one side of the holder member 38. Although face 64 is shown as convexly arched, it is not required that an arch be formed on that surface. The tool engaging face 62 of wedge member 57 could instead be provided with the convex arch. Likewise, the lowermost surface of cutting tool 56 could be convesly arched. However, it is preferred that one of those surfaces be convexly arched to provide the resulting line contact, which has been found to provide a tighter fit between wedge member 57, cutting tool 56 and socket 51.

When the support assembly 18 (FIG. 3) and the plates 29 are rotated clockwise as shown in FIG. 4, each of the members 38 tends to swing outwardly to the extended position shown in full lines in which the member 38 engages an associated restrainer stop member 41. At this position, the sharpened tip 66 of the tool 56 is in position to engage a pavement 72 (FIG. 4) with an impact to make a first cut 73 in the pavement 72 indicated in dashed lines in FIG. 4. The member 38 bounces back against the associated retraction stop member 42 and rebounds to make a second cut 74. The holder member 38 and the tool 56 can rebound a second time to make a third cut 76 before the tool 56 swings free of the pavement 72.

Although wheel 18 carries a number of cutter members and an equal number of restraining stop members and of retraction stop members, each cutter member has only one associated restraining stop member, and only one associated retraction stop member. As the wheel begins to rotate, inertia causes the cutter members to swing backwardly, relative to the wheel, opposite the direction of rotation, and the restraining stop members (referred to as the "associated restraining stop members") are so positioned as to restrain the cutter member from becoming fully radially extended as the wheel rotational speed increases. Similarly, the associated retraction stop member is positioned behind the cutter member, when considered relative to the direction of rotation of wheel 18, so as to limit its rearward travel after impacting the work surface.

In operation, the rotation of the drum causes a centrifugal force to act at the center of gravity of each of the cutter holders 38 in such a way as to tend to cause the center of gravity to be located on a radial line extending from the center of the drum and through the center of the pivot point. As the holder is restrained from reaching that fully-extended position, such as by means of a restraining stop member 41 (see FIG. 4), there is created a tangential component of force in the direction of rotation, the magnitude of which tangential force is dependent upon the location of the restraining stop member 41 with respect to the holder pivot point 33. As the restraining stop member 41 is moved along spacer plate 29 in a direction opposite to the direction of rotation of wheel 18, a line drawn from the center of pivot point 33 through the center of gravity of holder 38 will make an increasingly larger angle with a radial line which extends from the center of wheel 18 through pivot point 33. It has been found experimentally that the optimum angle is 22½° when concrete is the material being cut. When the angle is larger or smaller than that figure, the volume of material removed by the cutter is reduced. Although the preferred angle is 22½°, the range of angles which would still give reasonably good material removal rates would be in the range of from about 20° to about 25°.

Also as a result of experimentation, it has been found that the preferred location for the point where restraining stop 41 makes contact with cutter holder member 38 is at a point where an arc of one-half the distance from pivot point 33 to the center of gravity of cutter holder member 38 intersects the leading face of cutter holder member 38.

When cutter holder member 38 is in contact with restraining stop member 41, the position of cutting edge 66 in relation to the center of the wheel 18 and the center of rotation about pivot point 33 preferably defines a straight line for optimum material removal. That condition is unaffected by the angle the cutting face makes with the lowermost surface of the cutting bit, and also is independent of the angle at which the cutter member is restrained. Additionally, as the weight of cutter holder member 38 is increased, the force it exerts against restraining stop member 41 increases. However, too heavy a cutter holder member will slow down its rearward motion after the initial impact, reducing the impact velocity between cutter holder member 38 and retraction stop member 42, and thereby tending to reduce the number of multiple impacts which the present device is capable of delivering. Another factor in connection with the multiplicity of impacts is the rotational speed of the wheel 18; the faster wheel 18 turns, the lighter must be cutter holder members 38 in order to permit multiple impacts in connection with use of the device on concrete surfaces.

Restraining stop member 41 is preferably of rigid construction and the contact between it and cutter holder member 38 may either be line contact or surface contact. Providing an arcuate restraining stop surface in contact with the leading edge 78 of cutter holder member 38 will provide a line contact between the two surfaces, tending to minimize the effects of chips and other foreign material, which when interposed between those two surfaces could materially reduce the cutting efficiency of the present invention. Additionally, the surface hardness of restraining stop member 41 is preferably in the range of from 37 to 40 on the Rockwell C scale.

With reference to the retraction stop members, it is preferred that those members have an arcuate surface in order to make line contact with their associated cutter holder members 38. The desired line contact would provide the elastic impact necessary to permit rapid rebound of the cutter holder member so as to permit multiple cuts to be effected. Additionally, it is preferred that the surface hardness of the retraction stop members be within the range of from 37 to 40 on the Rockwell C scale, and that they be substantially non-deformable to permit the desired elastic impact.

Insofar as cutting angles are concerned, it has been found that the preferred angle of the cutter tip is of the order of 2½°, and the preferred angle is of the order of 5°.

Although the rotational speed of wheel 18 is widely variable, it has been observed that a suitable range of rotational speeds can be from about 180 rpm to about 800 rpm. The optimum speed would be a function of the cutter holder weight, the position of the restraining stop, the position of the retraction stop, and the drum diameter. Preferred wheel rotational speeds for planing concrete are between 300 and 500 rpm.

The support assembly 18 (FIG. 3) and the plates 29 are rotated by a motor 81 (FIGS. 1 and 2) mounted on the framework 12. The motor 81 drives a pulley 82 on which a belt 83 runs. The belt 83 drives a pulley 84 mounted on a shaft 86. The shaft 86 is rotatably mounted on the framework 12. A pulley 88 mounted on the shaft 86 drives a belt 89 which runs on a pulley 91 (FIG. 2) mounted on the flange member 21 to drive the assembly 18.

The machine 10 is advanced along the pavement 72 by operation of a motor 94 mounted on the framework 12. The motor 94 drives a pulley 96 on which a belt 97 runs. The belt 97 drives a pulley 98 mounted on a shaft 99 which carries a pulley 101. The pulley 101 drives a belt 102 which runs on a pulley 103 mounted on a shaft 104. The shaft 104 carries pulleys 106 on which belts 107 run. The belts 107 drive the wheels 14 to cause the machine 10 to advance.

The assembly 18 can be rotated at a speed to cause the tools 56 to chip the surface of the pavement 72. For a machine in which the radial distance from the center of rotation of the assembly 18 to the tips 66 of the tools 56 in extended position is one foot, the rate of rotation can be approximately 180 revolutions per minute. The machine is advanced at a speed which permits clean chipping of the surface of the pavement. As shown in FIG. 3, tools 56A mounted on cutter holder members 38A mounted between plates 29A and 29B overlap tools 56B mounted on cutter holder members 38B mounted between the plates 29B and 29C so that a broad cut 111 (FIG. 2) is made in the surface of the pavement 72.

Figure 7:
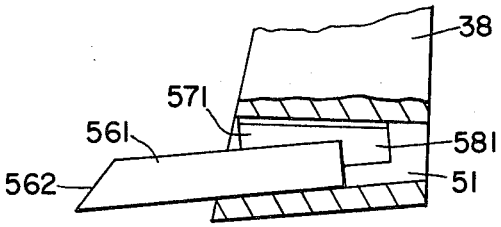
FIG. 7 is a fragmentary view partly in side elevation and partly in section of a cutter holder member and a sharpened tool.

When one of the tools 56 has become worn, the tool 56 and the wedge 58 can be advanced to the left as shown in FIG. 4 to be released from the socket 51, and the tool 56 can be sharpened to form a sharpened tool 561 with a reformed face 562 as shown in FIG. 7. The sharpened tool 561 can be mounted in the socket 51 with a wedge 571 having a large hook arm portion 581 to accommodate the sharpened tool.

The position of the stops can be varied for cutting different types of material, such as portland concrete, bituminous asphalt, ores, stone, coal, or the like. The center distance between pivot 33 and restraining stop 41, the angle of restraint of the cutter holder member, the distance of swing of the cutter holder member, the angle of the face of the chisel tool, the radial distance between the stops 41, 42 and the center of wheel 18, the weight of cutter holder element 38, and the rotational speed can also be varied.

The machine has been described in particular with reference to planing of a concrete pavement, but the machine can be used for other purposes, such as the mining of coal from a coal seam, and the machine illustrated in the drawings and described above is subject to structural modification without departing from the spirit and scope of the appended claims.

Having described my invention, what I claim as new and desire to secure by Letters Patent is:

1. A planing device for removing portions of a non-metallic surface, said device comprising: a frame; at least one wheel rotatably carried by said frame; means for rotating said wheel; a plurality of cutter members pivotally mounted on said wheel and having cutting edges which extend beyond the periphery of said wheel; a plurality of restraining stop members equal in number to the number of said cutter members and each of which is positioned on said wheel between a pair of cutter members and radially outwardly of the pivot points of said cutter members, each of said restraining stop members being positioned with respect to an associated cutter member to restrain the forward movement of said cutter member when said wheel is rotated and to maintain the center of gravity of said cutter member behind a radial line from the center of rotation of said wheel through the pivot point of said cutter member, whereby upon rotating said wheel said cutter members are restrained from reaching a fully-extended position; and a plurality of retraction stop members equal in number to the number of said cutter members and each of which is positioned on said wheel between a pair of cutter members, each of said retraction members being so positioned with respect to an associated cutter member as to limit the rearward movement thereof after said cutter member has impacted the surface being cut, said retraction stop members each having elastic line contact with its associated cutter member whereby to permit said cutter member to rebound therefrom and into touching relationship with said restraining stop member, said retraction stop members have an arcuate surface and have a surface hardness within the range of 37 to 40 on the Rockwell C scale and wherein said retraction stops are replaceable annular members.

2. The device of claim 1 wherein said retraction stops are substantially non-deformable.

3. The device of claim 2 where said restraining stops are replaceable annular members.

4. The device of claim 3 wherein each cutter member carries a removable cutting tool having a sharpenable cutting edge.

5. The device of claim 4 wherein said cutting edges of said cutter members lie on a radial line drawn through the center of its associated pivot point when said cutter members are in contact with their associated restraining stop members.

6. The device of claim 5 where the cutter member has an opening having tapering walls and wherein the cutting tool is held in position between said tapering walls by means of a wedge member.

7. The device of claim 6 wherein the portion of said wedge member which contacts said cutting tool has a convex surface.

8. The device of claim 6 wherein the surface of said cutting tool in contact with the tapering wall of said cutter member has a convex surface.

* * * * *